US008210240B2

(12) United States Patent
Huang et al.

(10) Patent No.: US 8,210,240 B2
(45) **Date of Patent: *Jul. 3, 2012**

(54) CASTING PROCESSES, CASTING APPARATUSES THEREFOR, AND CASTINGS PRODUCED THEREBY

(75) Inventors: Shyh-Chin Huang, Latham, NY (US); Stephen Francis Rutkowski, Duanesburg, NY (US); Michael Francis Xavier Gigliotti, Jr., Niskayuna, NY (US); Roger John Petterson, Sun City West, AZ (US); Lawrence Bernard Kool, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 472 days.

This patent is subject to a terminal disclaimer.

(21) Appl. No.: 12/474,475

(22) Filed: May 29, 2009

(65) Prior Publication Data

US 2010/0304161 A1 Dec. 2, 2010

(51) Int. Cl.
*B22C 9/04* (2006.01)
*B22D 27/04* (2006.01)

(52) U.S. Cl. ..... 164/518; 164/516; 164/519; 164/122.1

(58) Field of Classification Search ..... 164/516–519, 164/122.1

See application file for complete search history.

(56) References Cited

U.S. PATENT DOCUMENTS

| | | | | |
|---|---|---|---|---|
| 4,703,806 | A | 11/1987 | Lassow et al. | |
| 4,904,411 | A * | 2/1990 | Novich et al. | 516/33 |
| 5,047,181 | A * | 9/1991 | Occhionero et al. | 264/28 |
| 5,221,336 | A | 6/1993 | Horton | |
| 5,464,797 | A | 11/1995 | Yasrebi et al. | |
| 5,643,844 | A | 7/1997 | Yasrebi et al. | |
| 6,237,671 | B1 | 5/2001 | Lassow et al. | |
| 2006/0102052 | A1 * | 5/2006 | Doles | 106/634 |
| 2006/0130996 | A1 | 6/2006 | Bewlay et al. | |
| 2008/0119347 | A1 | 5/2008 | Sturgis et al. | |

FOREIGN PATENT DOCUMENTS

WO WO2008138026 11/2008

* cited by examiner

*Primary Examiner* — Kuang Lin
(74) *Attorney, Agent, or Firm* — Ann M. Agosti

(57) ABSTRACT

A casting process and apparatus for producing directionally-solidified castings, and castings produced therewith. The process entails applying a facecoat slurry to a surface within a mold cavity to form a continuous solid facecoat on the surface, introducing a molten metal alloy into the mold cavity so that the molten metal alloy contacts the facecoat, and then immersing the mold in a liquid coolant to cool and solidify the molten metal alloy and form a casting of the metal alloy, during which an oxide layer forms on the casting surface. The facecoat is sufficiently adherent to the oxide layer such that at least a portion of the facecoat detaches from the mold surface and remains tightly adhered to the casting surface in the event the casting contracts during cooling. The facecoat contains at least 60 weight percent of a first phase of yttria, and the balance of the facecoat is a binder phase of an inorganic material.

15 Claims, 3 Drawing Sheets

CASTING PROCESSES, CASTING APPARATUSES THEREFOR, AND CASTINGS PRODUCED THEREBY

BACKGROUND OF THE INVENTION

The present invention generally relates to casting equipment and processes. More particularly, the invention relates to reducing surface defects in directionally-solidified castings, including single-crystal (SX) and directionally-solidified (DS) castings.

Hot gas path components of gas turbines, such as blades (buckets), vanes (nozzles) and combustor components, are typically formed of nickel-, cobalt- or iron-based superalloys characterized by desirable mechanical properties at turbine operating temperatures. Because the efficiency of a gas turbine is dependent on its operating temperatures, there is a demand for hot gas path components that are capable of withstanding higher temperatures. As the material requirements for gas turbine components have increased, various processing methods and alloying constituents have been used to enhance the mechanical, physical and environmental properties of components formed from superalloys. For example, buckets, nozzles and other components employed in more demanding applications are often cast by directional casting techniques to have DS or SX microstructures, characterized by a crystal orientation or growth direction in a selected direction to produce columnar polycrystalline or single-crystal articles. As known in the art, directional casting techniques generally entail pouring a melt of the desired alloy into an investment mold held at a temperature above the liquidus temperature of the alloy, and then gradually withdrawing the mold into a cooling zone where solidification initiates at the base of the mold and the solidification front progresses upward.

Investment molds are typically formed by dipping a wax or plastic model or pattern of the desired component into a slurry comprising a binder and a refractory particulate material to form a slurry layer on the pattern. Common materials for the refractory particulate material include alumina, silica, zircon and zirconia, and common materials for the binder include silica-based materials, for example, colloidal silica. A stucco coating of a coarser refractory particulate material is typically applied to the surface of the slurry layer, after which the slurry/stucco coating is dried. The preceding steps may be repeated any number of times to form a shell mold of suitable thickness around the wax pattern. The wax pattern can then be eliminated from the mold, such as by heating, after which the mold is fired to sinter the refractory particulate materials and achieve a suitable strength. To produce hollow components, such as turbine blades and vanes having intricate air-cooling channels, one or more cores are provided within the shell mold to define the cooling channels and any other required internal features. Cores are typically prepared by baking or firing a plasticized ceramic mixture, and then positioned within a pattern die cavity into which a wax, plastic or other suitably low-melting material is introduced to form the pattern for the mold. Once solidified, the pattern with its internal cores can be used to form the shell mold as described above.

A particular known investment casting process employs a Bridgman-type furnace to create a heated zone surrounding the mold, and a chill plate at the base of the mold. Solidification of the molten alloy within the mold occurs by gradually withdrawing the mold from the heated zone and into a cooling zone beneath the heated zone, where cooling occurs by convection and/or radiation. A high thermal gradient is required at the solidification front to prevent nucleation of new grains during directional solidification processes. For example, commonly-assigned U.S. Pat. No. 6,217,286 to Huang et al. discloses a casting process that achieves a high thermal gradient at the solidification front with the use of a cooling zone that comprises a tank containing a liquid cooling bath, such as molten tin or another molten metal.

Mechanical properties of DS and SX articles depend in part on the avoidance of casting defects, including pitting and other surface defects that may result from chemical reactions with the mold during the solidification process. One potential source of surface defects is a molten metal coolant noted above for achieving high thermal gradients during solidification. An undesirable cast surface reaction may occur if the coolant penetrates the mold by infiltration of porosity or a crack in the mold prior to the completion of the casting operation. Consequently, shell molds used in investment casting processes must exhibit sufficient strength and integrity to survive the casting process.

Additional challenges are encountered when attempting to form castings of alloys that contain an appreciable amount of one or more reactive materials, including nickel-based superalloys that contain niobium, titanium, zirconium, yttrium, tantalum, tungsten, rhenium and potentially other elements that tend to readily react with oxygen when molten or at an elevated temperature. For this reason, surfaces of molds and cores used in the casting of materials containing reactive elements may be provided with protective barriers known as facecoats. Facecoats are generally applied to mold and core surfaces in the form of a slurry, which may be dried and sintered prior to the casting operation or undergo sintering during the casting operation. Typical facecoat slurries comprise a refractory particulate material in an aqueous-based inorganic binder, optionally with various additional constituents such as organic binders, surfactants, dispersants, pH adjusters, etc., to promote the processing, handling, and flow characteristics of the slurry. The refractory particulate material is chosen on the basis of being sufficiently unreactive or inert to the particular reactive material being cast. Various facecoat materials have been used and proposed, including those containing yttria ($Y_2O_3$), alumina ($Al_2O_3$), and zirconia ($ZrO_2$) in a colloidal silica binder.

BRIEF DESCRIPTION OF THE INVENTION

The present invention provides a casting process and apparatus for producing directionally-solidified castings, as well as castings produced with the process and apparatus.

According to a first aspect of the invention, a directional solidification process is provided that entails a facecoat slurry applied to a surface within a mold cavity to form a continuous solid facecoat on the surface. The facecoat consists essentially of at least 60 weight percent of a first phase containing yttria, and the balance of the facecoat is essentially a binder phase consisting essentially of an inorganic material. After a molten metal alloy is introduced into the mold cavity so that the molten metal alloy contacts the facecoat, the mold is immersed in a liquid coolant to cool and solidify the molten metal alloy and form a casting of the metal alloy, during which an oxide layer forms on a surface of the casting. The facecoat is sufficiently adherent to the oxide layer such that at least a portion of the facecoat detaches from the mold surface and remains tightly adhered to the casting surface in the event the casting contracts during cooling. Thereafter, the mold can be removed from the liquid coolant, and the casting with the oxide layer and remnant facecoat can be removed from the mold.

Another aspect of the invention are castings produced by the directional solidification process described above, including the oxide layer and the remnant portion of the facecoat on the casting at the conclusion of the casting operation. Following the casting operation, the oxide layer and remnant facecoat can be removed from the casting prior to carrying out further processes on the casting.

According to yet another aspect of the invention, a directional solidification casting apparatus is provided that includes a mold and a continuous solid facecoat on a surface of a cavity within the mold. The facecoat consists essentially of at least 60 weight percent of a first phase containing yttria, with the balance of the facecoat being essentially a binder phase consisting essentially of an inorganic material. The mold cavity is adapted to receive a molten quantity of a metal alloy so that the molten metal alloy contacts the facecoat. The apparatus further includes a liquid coolant adapted to immerse the mold, cool and solidify the molten quantity of the metal alloy within the mold, and form a casting of the metal alloy.

Casting materials for which this invention is particularly advantageous include superalloys, and particularly nickel-based alloys which may contain various alloying constituents capable of forming the oxide layer on the casting. A notable advantage of the invention is that the facecoat and oxide layer on the casting form a protective barrier that is capable of reducing and preferably prevents reactions that might otherwise occur between the casting alloy and the liquid coolant during the casting operation if the liquid coolant is able to infiltrate porosity or cracks in the mold. Another notable advantage is that the facecoat is very adherent to the oxide layer, such that if the casting sufficiently contracts during cooling at least the portion of the facecoat contacting the oxide layer will remain tightly adhered to the oxide layer and tend to delaminate from any portion of the facecoat that might remain bonded to the mold surface. As a result, the adherent portion of the facecoat and the oxide layer continue to define a protective barrier on the casting surface. Other advantages associated with the facecoat include a long shelf life exhibited by the facecoat slurry due to improved stability, a high solids loading for achieving desirable casting surface finishes, and strength and relatively low porosity to provide a reliable protective barrier between the molten alloy and the mold. The facecoat slurry also exhibits relatively low viscosities for achieving desirable mixing properties.

Other aspects and advantages of this invention will be better appreciated from the following detailed description.

DETAILED DESCRIPTION OF THE INVENTION

Figure 1:
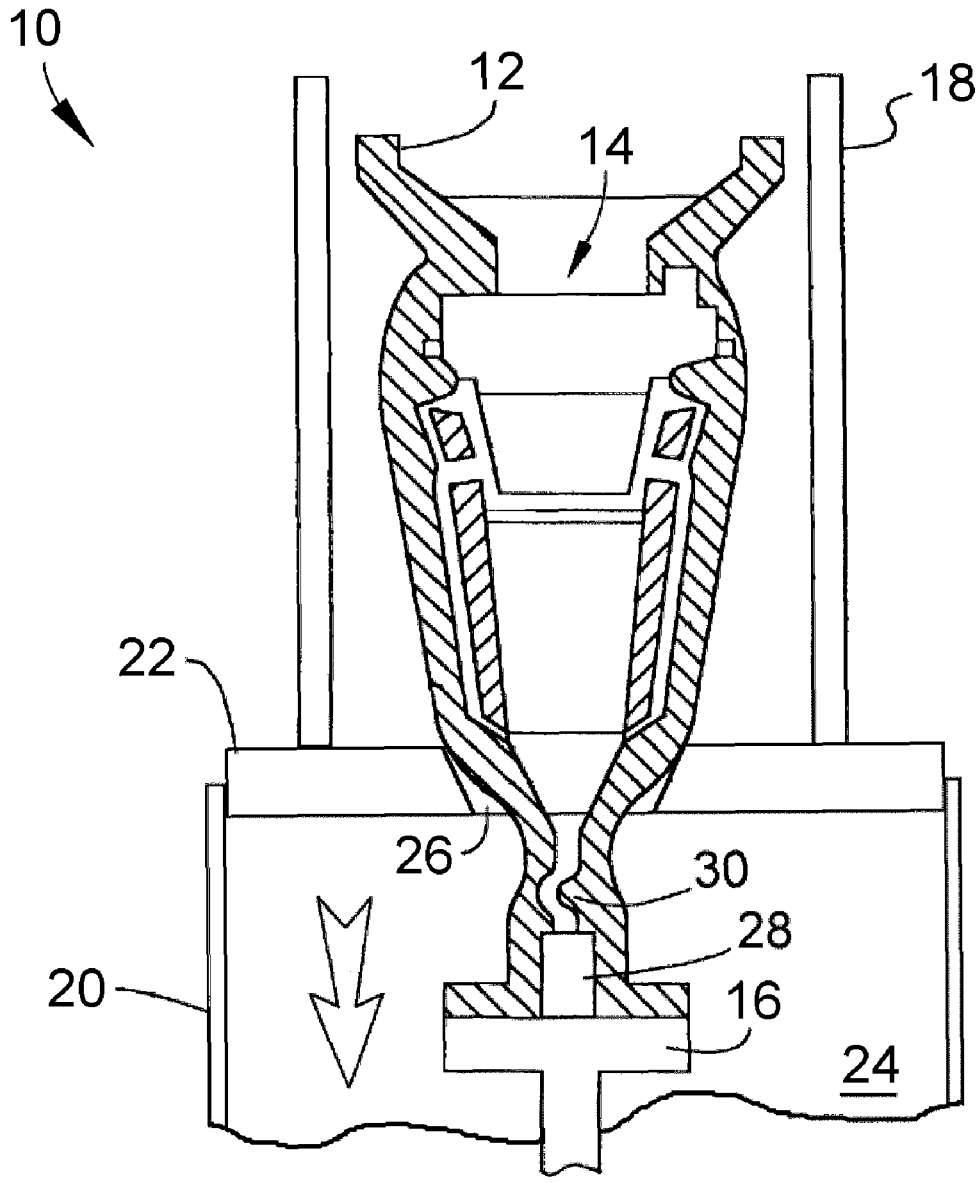
FIG. 1 represents a cross-sectional view of a directional solidification casting apparatus.
Figure 3:
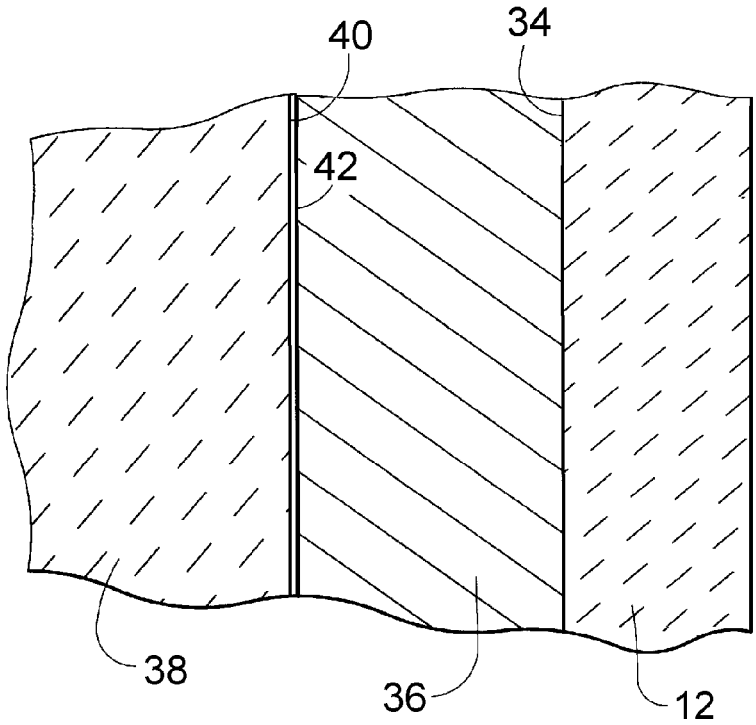
FIG. 3 represents a fragmentary cross-sectional view of the mold assembly of FIG. 2 and shows a casting contacting a facecoat formed by the slurry of FIG. 2.

FIG. 1 schematically represents a casting apparatus 10 that can be used with the present invention. The apparatus 10 and its following description are intended as a nonlimiting representation that shows a shell mold 12 capable of producing a directionally solidified casting by an investment casting process. As known in the art, the mold 12 is preferably formed of a refractory material such as alumina, silica, etc., and defines an internal mold cavity 14 having the desired shape of the casting, for example, a turbine blade or bucket. As represented in FIG. 3, an interior cavity surface 34 of the mold 12 is provided with a solid facecoat 36, whose composition is preferably in accordance with the more detailed discussion provided below.

Consistent with known investment casting processes, the cavity 14 may be defined through the use of a wax pattern (not shown) whose shape corresponds to the desired shape of the casting. The pattern is removed from the shell mold 12 prior to the casting operation, such as with conventional techniques including flash-dewaxing, microwave heating, autoclaving, and heating in a conventional oven. The cavity 14 may contain cores (not shown) for the purpose of forming internal cavities or passages within the casting.

The mold 12 is shown secured to a chill plate 16 and located within a heating zone 18 (for example, a Bridgman furnace) to heat the mold 12 to a temperature at least equal to and preferably above the melting temperature of the casting alloy. The apparatus 10 is shown as equipped for unidirectional solidification of the casting. For this purpose, a cooling zone 20 is represented as being located directly beneath the heating zone 18, and a baffle or heat shield 22 is represented as being between and separating the heating and cooling zones 18 and 20. The heat shield 22 is useful for insulating the cooling zone 20 from the heating zone 18 to promote a steep thermal gradient that will be experienced by the mold 12 as it exits the heating zone 18 and enters the cooling zone 20. The heat shield 22 may have a variable-sized opening 26 that enables the shield 22 to fit closely around the shape of the mold 12 as it is withdrawn from the heating zone 18, through the heat shield 22, and into the cooling zone 20.

According to a particular aspect of the invention, the cooling zone 20 is represented as comprising a tank that contains a liquid coolant 24, typically a molten metal though the use of other materials is foreseeable. A variety of metals can potentially be used as the liquid coolant 24, including relatively low-melting metals such as lithium, magnesium, aluminum, zinc, gallium, indium, and tin. Particularly suitable liquids for the coolant 24 are believed to be molten tin at a temperature of about 235° C. to about 350° C., or molten aluminum at a temperature of up to about 700° C. Molten tin is more commonly used and believed to be preferred because of its low melting temperature and low vapor pressure.

The casting process is preferably carried out in a vacuum or an inert atmosphere. As will be discussed in more detail below, to promote sintering of the facecoat 36 and the formation of a metal oxide layer 42 (FIG. 3) containing desirable metal surface oxides that in combination are capable of forming a continuous reaction barrier on the casting surface 40, a more reactive atmosphere, such as a mixture of argon and carbon monoxide, can also be used. After the mold 12 is preheated to a temperature above the casting alloy's melting (liquidus) temperature, the molten alloy is poured into the preheated mold 12 and then, in accordance with conventional practices for unidirectional solidification, the mold 12 and chill plate 16 are withdrawn at a fixed withdrawal rate into the cooling zone 20 until the mold 12 is entirely within the cooling zone 20. The temperature of the chill plate 16 is preferably maintained at or near the temperature of the cooling zone 20, such that dendritic growth begins at the lower end of the mold 12 and the solidification front travels upward through the mold 12. If a single crystal structure is desired, the casting can be caused to grow epitaxially based on the crystalline structure and orientation of a small block of single-crystal seed material 28 at the base of the mold 12, from which a single crystal forms from a crystal selector 30, for example, a pigtail sorting structure.

Figure 2:
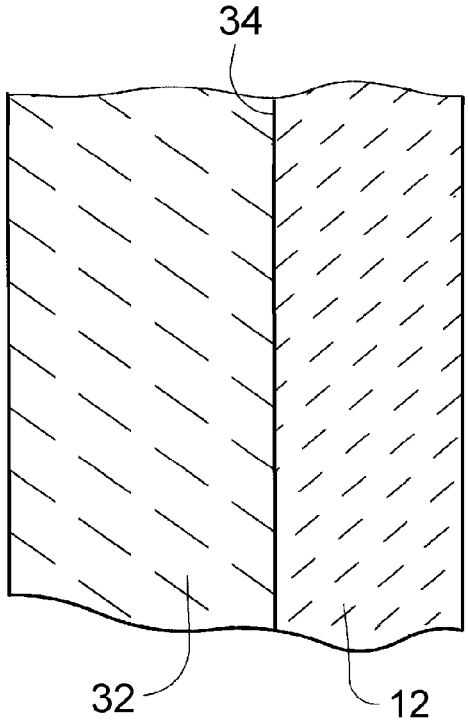
FIG. 2 represents a fragmentary cross-sectional view of a mold assembly of FIG. 1 and shows a facecoat slurry applied to an interior mold cavity surface in accordance with an embodiment of the invention.

Various alloys can be cast using a casting apparatus of the type represented in FIG. 1. Of particular interest to the invention is the casting of superalloys, especially nickel-based superalloys, which are prone to casting surface defects if the coolant 24 within the cooling zone 20 is able to infiltrate cracks or porosity in the mold 12 and chemically react with the casting alloy during the solidification process. Accordingly, a particular aspect of this invention is to reduce if not eliminate metal/coolant reactions that can occur in liquid metal cooled casting processes of the type described above with the aforementioned facecoat 36 represented in FIG. 3. FIG. 2 represents a fragment of a wall section of the mold 12 of FIG. 1 as having a layer of a facecoat slurry 32 applied to its interior cavity surface 34, which is then heated and sintered to form the solid facecoat 36 shown in FIG. 3. Various techniques can be employed to apply the slurry 32 to the mold 12. As conceptually shown in FIG. 2, a nonlimiting example is to "wash" the interior cavity surface 34 of the mold 12 after the mold 12 is fabricated by, for example, a conventional slurry and stucco process. Another nonlimiting example is to incorporate the facecoat slurry 32 into a conventional mold dipping process by applying the facecoat slurry 32 as the first coat on the wax pattern. As a result, the washed or dipped facecoat slurry 32 will form the facecoat 36 as the outermost surface region on the mold cavity surface 24, which will therefore be in direct contact with a metal cast with the mold 12. The facecoat slurry 32 thus needs to be formulated to prevent or at least inhibit casting surface defects, a particular example of which is defects resulting from reactions with molten tin used as the coolant 24 during the casting process.

Heating and sintering of the facecoat slurry 32 to form the facecoat 36 can be performed by firing to about 1000° C. prior to introducing the molten alloy into the mold cavity 14. Additional sintering can occur in situ as a result of the mold 12 being preheated to above the metal melting temperature and molten alloy being introduced into the mold cavity 14 while the pre-fired facecoat slurry 32 is still present on the mold cavity surface 34. Though not shown, it should be understood that a core placed in the mold cavity 14 may also be provided with a layer of the same or similar slurry to form a facecoat. FIG. 3 schematically represents the appearance of the mold 12 and facecoat 36 following the introduction and solidification of a casting alloy within the shell mold cavity 14 to form a casting 38. Because the shell mold 12 and its facecoat 36 can be used in substantially conventional investment casting processes as well as other types of casting processes, the casting process itself will not be discussed in any further detail.

As noted above, the facecoat 36 on the interior surface 34 of the mold 12 serves as a protective barrier to prevent the liquid coolant 24 on the exterior of the mold 12 from contacting and chemically reacting with the casting alloy during the solidification process. According to a particular aspect of the invention, preferred compositions for the facecoat 36 are also capable of reacting with the molten alloy during solidification to form the aforementioned metal oxide layer 42 on the surface 40 of the casting 38, which is capable of bonding a surface region layer of the facecoat 36 to the casting surface 40. The layer of facecoat 36 that remains bonded to the surface 40 of the casting 38 provides an additional barrier capable of protecting the casting surface 40 from chemical reactions with the liquid coolant 24.

According to a preferred aspect of the invention, the facecoat 36 is a ceramic-based composition that contains yttria ($Y_2O_3$) and a minimal amount of an inorganic binder, such that the facecoat 36 has a refractory phase in an inorganic binder phase. The facecoat 36 preferably consists essentially of the refractory and inorganic binder phases in the sense that the facecoat 36 is free of unintended phases or otherwise contains such phases at only impurity levels. The yttria refractory phase is the dominant phase of the facecoat 36 and constitutes at least 60 weight percent of the facecoat 36. The shell mold 12 may also be formed of the same or similar composition used to form the facecoat 36, though the presence of the facecoat 36 permits the use of traditional mold compositions for the mold 12.

As is generally conventional in the fabrication of facecoats for casting processes, the slurry 32 of FIG. 2 used to form the facecoat 36 of FIG. 3 contains a refractory powder mixed with binders and other ingredients intended to confer desirable properties to the slurry 32. According to a preferred aspect of this invention, the refractory powder is formed entirely of yttria particles (and likely impurities), and therefore is not intentionally a mixture of yttria and other oxides or ceramic materials. However, the presence of other oxides or ceramic materials is permissible, nonlimiting examples of which include alumina, zircon, zirconia, calcia, magnesia, and rare earth oxides. A suitable particle size for the yttria particles is up to about 44 micrometers, more preferably about 5 to about 40 micrometers. The yttria particles constitute at least 60 weight percent of the slurry 32, more preferably about 82 to about 88 weight percent of the slurry 32, with a suitable nominal content being about 85 weight percent, resulting in the slurry 32 having what will be termed a high-solids loading.

The slurry 32 is formed by combining the refractory powder with a particulate of the inorganic binder in an aqueous suspension, a thixotropic organic binder, a dispersant, and possibly optional constituents excluding particulate refractory materials and inorganic binders. The aqueous suspension containing the particulate inorganic binder preferably does not constitute more than 35 weight percent of the slurry 32, and more preferably constitutes about 1 to about 5 weight percent of the slurry 32, with a suitable nominal content of about 2.5 weight percent. This minimal amount of inorganic binder in the slurry 32 reduces the likelihood of potential reactions between the binder and the molten alloy placed in the mold 12. A preferred inorganic binder is believed to be entirely colloidal silica, though other inorganic binders could be used. The aqueous suspension preferably contains about 15 to about 40 weight percent inorganic solids, more preferably about 20 to about 30 weight percent inorganic solids, with a suitable nominal content of about 30 weight percent inorganic solids. The balance of the aqueous suspension is preferably water. A typical particle size for the inorganic binder particulate is generally about 14 nanometers and less. A commercial example of a suitable colloidal silica is Remasol® LP-30, available from Remet.

While additional additives, such as organic binders, surfactants, dispersants, defoaming agents, pH adjusters, etc., are known in the art as useful in facecoat slurries, slurry compositions preferred by the present invention selectively utilize certain additives in certain amounts that have been determined with this invention to compensate for the very high solids content and low inorganic binder content of the slurry 32, as described above. In particular, the slurry 32 is formulated to contain a dispersant whose composition is chosen in part on the basis of being capable of stabilizing the pH of the slurry 32 and maintaining the pH within a suitable range, preferably up to a pH of about 10 with a particular preferred example being a pH of 8.6 to 10.1. Dispersants believed to be suitable for use in the slurry 32 of this invention have the general formula $H_x[N(CH_2)_yOH]_z$, where x has a value of 0 (tertiary amines), 1 (secondary amines) or 2 (primary amines), y has a value of 1 to 8, and z=3−x. A preferred dispersant is believed to be triethanol amine ($N[(CH_2)_2OH]_3$), which is believed to have properties important to the slurry 32. First, triethanol amine is weakly basic and therefore capable of raising the pH of the slurry 32. Second, triethanol amine contains three alcohol functionalities that give it dispersant properties. Other compounds having the general formula $H_x[N(CH_2)_yOH]_z$ that could be used in the slurry 32 include monoethanol amine, diethanol amine, monopropanol amine, dipropanol amine, tripropanol amine. The dispersant constitutes at least 1 up to about 10 weight percent of the slurry 32, more preferably about 1 to about 5 weight percent of the slurry 32, with a suitable nominal content of about 2 weight percent. A commercial example of a suitable dispersant is Alfa Aesar® 22947 available from Alfa Aesar.

The slurry 32 is further formulated to contain a thixotropic organic binder that helps maintain the high solids loading of the slurry 32, while also promoting a smooth surface finish for the facecoat 36 and reducing the viscosity of the slurry 32, especially during mixing. The term thixotropic is used according to its ordinary meaning to denote certain materials whose viscosities change greatly with changes in shear (velocity). Preferred thixotropic organic binders also allow for lower mixing speeds, which are believed to promote the shelf life of the slurry 32 by reducing slurry friction and temperature during mixing. The thixotropic nature of the organic binder also allows the viscosity of the slurry 32 to be modified during mixing by adjusting the mixing speed. Thixotropic organic binders of particular interest to the invention include styrene-butadiene polymer dispersions particular suitable for use with colloidal silica binders. The organic binder constitutes at least 0.3 up to about 0.9 weight percent of the slurry 32, more preferably about 0.6 to about 0.7 weight percent of the slurry 32, with a suitable nominal content of about 0.6 weight percent. A commercial example of a suitable thixotropic organic binder is LATRIX® 6305 commercially available from the Ondeo Nalco Company.

The slurry 32 may contain other additives, such as surfactants, defoaming agents, additional organic binders, etc. For example, the slurry 32 may contain a wetting agent, such as NALCO® 8815 ionic wetting agent, and/or a defoamer such as NALCO® 2305 water-based defoamer, both commercially available from the Nalco Company. Notably, however, the slurry 32 preferably does not contain any further particulate constituents that would form any part of a solid phase in the facecoat 36. Instead, the thixotropic organic binder, dispersant, and any additional additives in the slurry 32 are preferably cleanly burned off during drying, heating and/or sintering of the slurry 32 to form the facecoat 36.

The slurry 32 can be prepared by standard techniques using conventional mixing equipment, and then undergo conventional processes to form the facecoat 36 on the mold cavity surface 34, such as by dipping, molding, or another suitable technique. Using these application methods, a suitable viscosity range for the slurry 32 is about five to about seven seconds using a standard #5 Zahn cup measurement. Suitable thicknesses for the slurry layer will depend on various factors, including the particular reactive material, mold material, and slurry composition. In general, the slurry is preferably applied to produce a facecoat 36 having a thickness of at least about 0.2 mm, for example, about 0.2 to about 0.6 mm and more preferably about 0.4 mm to produce a reliable protective barrier for the mold 12. The slurry 32 can be applied as multiple layers, for example, to promote separation by delamination so that a continuous layer of the facecoat 36 remains bonded to the casting surface 40 as the casting 38 contracts.

As previously noted, heating and sintering of the facecoat slurry 32 to form the facecoat 36 can occur prior to and during the introduction of molten alloy into the mold cavity 14. The layer of facecoat slurry 32 is preferably dried and fired prior to contact with the molten alloy in accordance with well-known practices. The organic binder, dispersant, and other additional additives of the slurry 32 preferably provide an adequate level of green strength to the slurry layer after drying, and then burn off completely and cleanly prior to or during firing, by which the particles of the refractory powder sinter. Drying can be performed at room temperature, which is then preferably followed by a pre-sintering step that entails heating at a rate of about 200° C./hour to a temperature of about 1000° C., a one-hour hold at about 1000° C., and then cooling at a rate of about 200° C./hour to room temperature. This intermediate firing procedure is preferably performed prior to firing at a final sintering temperature for the purpose of eliminating the organic additives within the slurry 32, and can be performed according to conventional techniques, for example, in a gas or electric furnace. Full sintering of the facecoat 36 occurs at around 1600° C., which can occur during the mold preheating step of the casting process. As understood in the art, suitable and preferred temperatures, durations, and heating rates during drying and firing will depend on factors such as slurry thickness, composition, particle size, etc. As such, the drying and firing temperatures and durations can vary significantly.

As a result of firing, the facecoat 36 is in the form of a monolithic low-porosity protective barrier on the cavity surface 34 that protects the mold 12 and prevents reactions between the mold 12 and the molten alloy, thereby reducing the likelihood of pitting and other potential surface defects in the casting 38 that can be caused by such reactions. The preferred composition for the facecoat 36 has been observed to react with and adhere to the casting surface 40, even as the casting 38 contracts and the casting surface 40 moves away from the mold 12 during cooling and solidification of the molten alloy. During contraction of the casting 38, the entire facecoat 36 may remain tightly adhered to the casting surface 40 through the oxide layer 42. In practice, the facecoat 36 has been observed to effectively delaminate, in which case a continuous portion of the facecoat 36 remains tightly adhered to the casting surface 40 through the oxide layer 42 while the remainder of the facecoat 36 tends to remain adhered to the surface 34 of the mold 12. The combination of the reacted metal oxide layer 42 and the facecoat 36 (or at least the remnant of the facecoat 36 remaining attached to the surface 40) provides a continuous reaction barrier on the casting surface 40 that serves to physically and chemically separate the entire casting surface 40 from any liquid coolant 24 that may have infiltrated the mold 12. The high-solid loading of the preferred facecoat slurry 32 promotes the formation of a dense facecoat 36, so that the oxide layer 42 and at least the remnant of the facecoat 36 remain tightly adhered to the casting surface 40 and prevent any reaction with the coolant 24 as the casting 38 shrinks away from the mold surface 34.

The composition of the oxide layer 42 will depend on the particular compositions of the casting alloy and facecoat 36. If the casting alloy contains aluminum, as typical with many nickel-based superalloys, the oxide layer 42 is believed to be primarily alumina ($Al_2O_3$). However, the oxide layer 42 may alternatively or further comprise other metal oxides, such as chromia ($Cr_2O_3$) and/or other oxides of metal elements present in the facecoat 36 and the casting alloy.

Investigations leading to the present invention have shown that the high-solids yttria facecoat 36 having compositions as described above can be successfully employed to cast nickel-based superalloys. For example, in one investigation a nickel-based superalloy was cast by a unidirectional solidification process using a casting apparatus generally as represented in FIG. 1. Molten tin was used as the coolant, and the high-solids yttria facecoat of this invention was present on the mold cavity surface. The facecoat had a thickness of about 300 micrometers. The nickel-based superalloy had a nominal composition of, by weight, about 7.5% cobalt, 9.75% chromium, 4.2% aluminum, 3.5% titanium, 0.5% niobium, 4.8% tantalum, 1.5% molybdenum, 6% tungsten, 0.15% hafnium, 0.08% carbon and 0.008% boron. Following the casting operation, the surface of the casting was observed to have retained a portion of the facecoat that was tightly adhered to the entire casting surface, while the remainder of the facecoat remained attached to the mold. When the bulk of the mold was removed, the casting and its remnant facecoat were found to be coated with a layer of tin that had infiltrated a crack in the mold from the surrounding molten tin coolant used in the solidification process. The mold had apparently cracked during the casting process, such that the casting together with the remnant facecoat on it surface had been immersed in molten tin during the casting operation.

Figure 4:
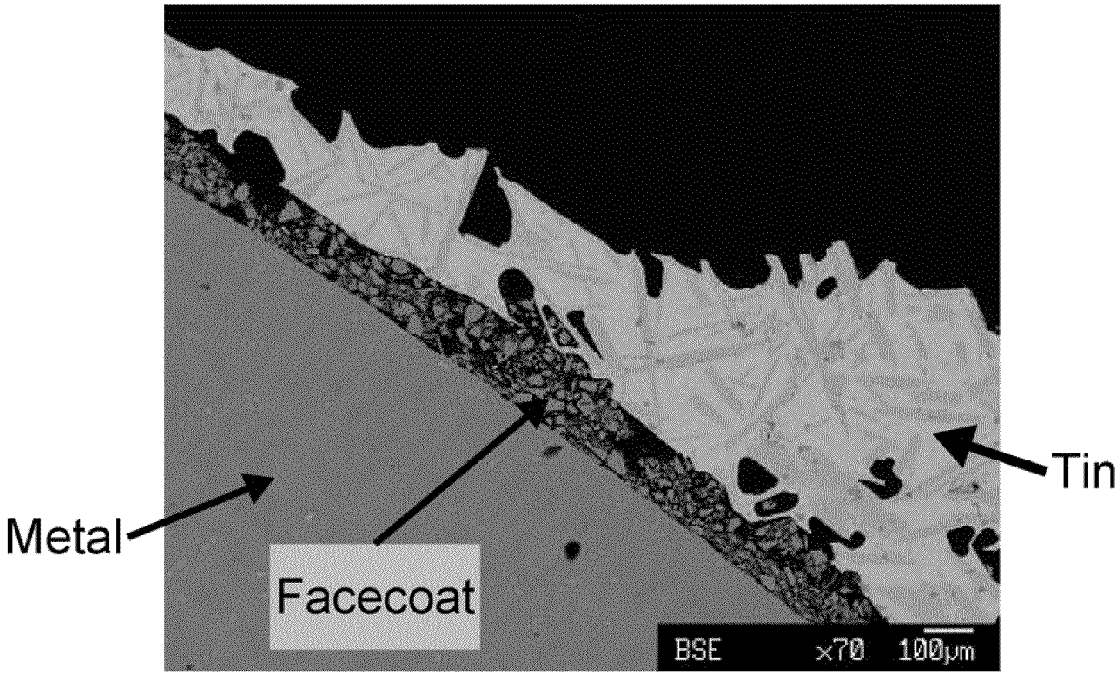
FIGS. 4 and 5 are scanned images of microphotographs showing the interface between a casting surface and a facecoat on the casting surface following an immersion in molten tin that infiltrated the mold during the casting operation.

The casting was then sectioned for metallographic examination and its surface was found to be covered with the facecoat remnant as well as the layer of infiltrated tin. FIG. 4 is an electron scanned image of a micrograph from the metallographic sample showing the cast metal, the layer of facecoat remnant (having a thickness of about 100 micrometers), and the infiltrated tin layer. The micrograph evidences two particular features of castings produced in a mold provided with a preferred yttria facecoat 36 of this invention. The first feature is the presence of the remnant facecoat that completely separates the tin layer from the metal surface of the casting. The second feature is that the casting surface is clean and free of any defects or other evidence of a reaction with the tin layer. The absence of reaction defects is particularly desirable from the standpoint of casting quality, and was concluded to be a result of the remnant facecoat, which served as a protective barrier between the casting and the infiltrated tin and protected the casting surface from being reacted by tin.

Figure 5:
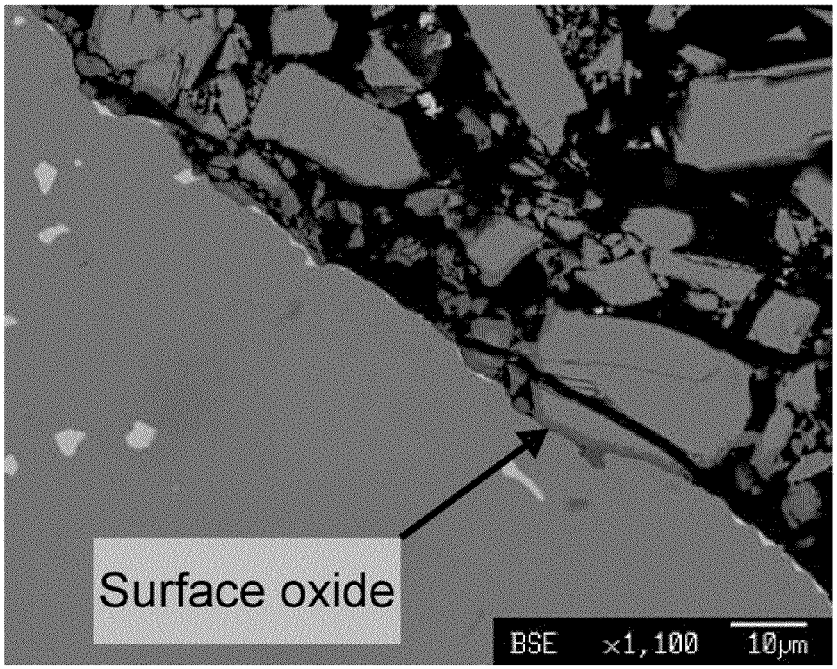

FIG. 5 is an electron scanned image of a microphotograph taken at a higher magnification showing the interface between the casting surface and the facecoat remnant shown in FIG. 4. FIG. 5 evidences the presence of an oxide layer between the casting surface and the remnant facecoat. The oxide layer was likely formed as a result of interaction between the casting metal and facecoat, and was concluded to be responsible for bonding the facecoat to the casting surface.

As evident from the images above, the remnant facecoat layer was continuous on the surface of the casting, and the oxide layer was nearly continuous on the casting surface. These images evidence that the original facecoat and the oxide layer grown in situ on the casting surface had successfully protected the casting surface during the casting operation, and thereafter the remnant facecoat and oxide layer had successfully protected the casting surface during the approximately two-hour immersion in tin during the casting operation. As such, the facecoat was shown to protect the casting surface from surface reactions with molten tin, which is advantageous for protecting a casting from reactions with a molten coolant in the event the mold cracks or is otherwise infiltrated by molten coolant during solidification of the casting.

While the invention has been described in terms of certain embodiments, it is apparent that other forms could be adopted by one skilled in the art. Therefore, the scope of the invention is to be limited only by the following claims.

The invention claimed is:

1. A directional solidification process for producing a casting, the process comprising:

providing a mold with a cavity and a continuous solid facecoat on a surface within the cavity and formed from a facecoat slurry applied to the surface, the facecoat consisting of:

at least 60 weight percent of a first phase consisting essentially of yttria;

at most 35 weight percent of an aqueous suspension containing a particulate inorganic binder;

a thixotropic organic binder; and a dispersant having the general formula $H_x[N(CH_2)_y OH]_z$, where x has a value of 0, 1 or 2, y has a value of 1 to 8, and z=3−x, the dispersant being present in the slurry in an amount sufficient to stabilize the slurry at a pH of up to about 10; and optionally constituents excluding particulate refractory materials and inorganic binders;

introducing a molten quantity of a metal alloy into the cavity of the mold so that the molten metal alloy contacts the facecoat;

immersing the mold in a liquid coolant to cool and solidify the molten quantity of the metal alloy and form a casting of the metal alloy, during which an oxide layer forms on a surface of the casting, the facecoat becoming sufficiently adherent to the oxide layer such that at least a portion of the facecoat detaches from the surface of the mold and remains tightly adhered to the surface of the casting in the event the casting contracts during cooling;

removing the mold from the liquid coolant; and then removing from the mold the casting with the oxide layer and at least the remnant portion of the facecoat thereon.

2. The directional solidification process according to claim 1, wherein the particulate refractory material of the facecoat slurry consists of yttria and impurities, and the first phase of the facecoat consists of yttria and the impurities.

3. The directional solidification process according to claim 1, wherein the aqueous-based facecoat slurry contains about 1 to about 5 weight percent of the aqueous suspension.

4. The directional solidification process according to claim 1, wherein the aqueous suspension is colloidal silica.

5. The directional solidification process according to claim 1, wherein the thixotropic organic binder is a styrene-butadiene polymer dispersion.

6. The directional solidification process according to claim 1, wherein the aqueous-based facecoat slurry contains about 0.3 to about 0.9 weight percent of the thixotropic organic binder.

7. The directional solidification process according to claim 1, wherein the dispersant is chosen from the group consisting of triethanol amine, diethanol amine, monoethanol amine, tripropanol amine, dipropanol amine, and monopropanol amine.

8. The directional solidification process according to claim 1, wherein the aqueous-based facecoat slurry contains about 1 to about 10 weight percent of the dispersant.

9. The directional solidification process according to claim 1, wherein the facecoat is formed by heating the aqueous-based facecoat slurry to remove water, the thixotropic organic binder, the dispersant, and the optional constituents if present and to sinter the particulate refractory material and the particulate inorganic material.

10. The directional solidification process according to claim 1, wherein the facecoat reacts with the metal alloy to form the oxide layer.

11. The directional solidification process according to claim 1, wherein the metal alloy is a nickel-based alloy.

12. The directional solidification process according to claim 11, wherein the facecoat reacts with the metal alloy to form the oxide layer.

13. The directional solidification process according to claim 12, wherein the oxide layer comprises alumina.

14. The directional solidification process according to claim 1, wherein the liquid coolant contains at least one molten metal chosen from the group consisting of lithium, magnesium, aluminum, zinc, gallium, indium and tin.

15. The directional solidification process according to claim 1, wherein the casting is a gas turbine engine component.

* * * * *